US005117817A

United States Patent [19]

Lin

[11] Patent Number: 5,117,817

[45] Date of Patent: Jun. 2, 1992

[54] VERTICAL CO-AXIAL MULTI-TUBULAR DIVING SNORKEL

[76] Inventor: Hsin-Nan Lin, No. 38, Alley 22, Lane 422, Sec. 1, Wan Shou Ts'un, Kuei Shan Hsiang, Taoyuan Hsien, Taiwan

[21] Appl. No.: 556,304

[22] Filed: Jul. 23, 1990

[51] Int. Cl.[5] ..... B63C 11/16

[52] U.S. Cl. ..... 128/201.11; 128/207.16

[58] Field of Search ..... 128/201.11, 207.16, 128/207.17, 207.18

[56] References Cited

U.S. PATENT DOCUMENTS

| | | | |
|---|---|---|---|
| 908,690 | 1/1909 | Neubert | 128/201.11 |
| 1,946,126 | 2/1934 | Black | 128/201.11 |
| 2,317,236 | 4/1943 | Wilen et al. | 128/201.11 |
| 2,362,240 | 11/1944 | Bonilla | 128/201.11 |
| 2,362,775 | 11/1944 | Sebouh | 128/201.11 |
| 3,141,469 | 7/1964 | Strodella | 128/201.11 |
| 4,071,024 | 1/1978 | Blanc | 128/201.11 |
| 4,793,341 | 12/1988 | Arasmith | 128/201.11 |
| 4,805,610 | 2/1989 | Hunt | 128/201.11 |
| 4,896,664 | 1/1990 | Harayama | 128/201.11 |

FOREIGN PATENT DOCUMENTS

| | | | |
|---|---|---|---|
| 959096 | 9/1953 | France | 128/201.11 |
| 413009 | 3/1946 | Italy | 128/201.11 |
| 524692 | 4/1955 | Italy | 128/201.11 |
| 712617 | 9/1966 | Italy | 128/201.11 |

*Primary Examiner*—Edgar S. Burr
*Assistant Examiner*—Aaron J. Lewis
*Attorney, Agent, or Firm*—Lackenbach Siegel Marzullo Aronson & Greenspan

[57] ABSTRACT

A vertical co-axial multi-tubular diving snorkel which is characterized by the following structural design: an inner tube is disposed inside an outer tube of snorkel, these two tubes are co-axial but their calibers obviously differ from each other so as to form two separate channels; a middle thimble is provided inside the top of outer tube, a plurality of intake valve ports are provided to the top of said middle thimble, an annular flat one-way check diaphragm (referred to as the inhaling diaphragm hereinafter to only let the foreign air enter into the snorkel) is provided to the top surface of said intake valve ports; a flat one-way check diaphragm (referred to as the exhaust diaphragm hereinafter to only let the air in the snorkel be exhausted out of the snorkel), an annular body as a housing is provided to the top of snorkel and with a plurality of spaced intake holes and exhaust holes nearby the inhaling and exhaust diaphragms, an annular flat water check diaphragm (referred to as the water check diaphragm hereinafter) and a sleeve type float (referred to as the float hereinafter) are disposed in sequence below the foregoing intake valve ports on the top edge on the inner periphere of intake holes, and normally the water check diaphragm is on the bottom edge on the inner periphere of said intake holes; and based on such a structure, when the diver uses the snorkel of the present invention for breathing, he or she can avoid inhaling the waste carbon dioxide exhaled by himself or herself because there are different channels for separate intake and exhaust, and during use, when the float contacts the water, the float will be subject to the floating force of water and immediately rise up to push the water check diaphragm to close the intake valve ports so as to prevent the water from flowing into the snorkel.

9 Claims, 5 Drawing Sheets

VERTICAL CO-AXIAL MULTI-TUBULAR DIVING SNORKEL

BACKGROUND OF THE INVENTION

As one of the major aids used by the bare-handed diver when diving, the snorkel is designed to help the diver keep continued breathing while floating in the water to search for watching the underwater scene.

The most widespread snorkel is a simple J-shaped hollow pipe made of rubber or plastic, about 30–35 cm long with a caliber of about 1.5–2.0 cm. When to use it, the snorkel is installed at the front end of rubber tape on one side of diving mask, the mouth at the top end of snorkel is open, and the bent part at the lower end thereof is held in the diver's mouth so that he or she can breathe with his or her mouth. When folating up, the said mouth at the top end of snorkel is about 10 cm above the water level, the diver can watch the underwater scene on the one hand and keep continued breathing through the snorkel on the other hand. However, when diving down, the snorkel will sink together with the diver, the water will naturally enter into the snorkel through the said mouth at the top end thereof, so the diver has to close his or her mouth tightly and he or she will not swallow the water in the snorkel. When floating up, the diver has to drain the water in the snorkel in order to be able to breathe continuously, such an action is called "blowing snorkel" which denotes that the diver forcefully jets out the air in his or her abdomen through his or her mouth and the water in the snorkel is then frained from the mouth at the top end thereof through the air pressure, so the diver can breathe continuously. What is mentioned above indicates the structure and usage of snorkel in general.

The foregoing conventional snorkel during use has the following drawbacks:

(1) When floating up after diving down, the diver is always in urgent need of breathing the air in quantities as soon as possible but he or she has to perform "blowing snorkel" forcefully so as to be able to breathe through draining the water in the snorkel, his or her difficulty is imaginable. Therefore, the diver is always hurrying up to pull out the said bent part at the lower end of snorkel from his or her mouth (such an action is the so-called "pulling snorkel") but omitting the action of "blowing snorkel" so as to float up to breathe with his or her mouth at once (The divers in general urgently need oxygen in quantities when they float up since they feel suffocated for a long time during diving down, it is not enough for them to only breathe with nose). If the water in the snorkel is not well drained through "blowing snorkel", the diver swallowed the said water to cause choking the bronchia with water (Most of the drowned are suffocated to death because of choking the bronchia with water—a phenomenon of water accumulated in the lungs, and such a choking in 1–2 minutes will lead to death).

(2) Since the water in the snorkel cannot be entirely drained, a little bit of such water will accumulate in the bottom at the lower end of snorkel (namely, the bent part thereof), and when the diver uses it once again, the passage. of breathing air flow will generate an odd noise, he or she feel suffering something like pneumonia and asthma, it has to drain the accumulated water as a whole in the snorkel and then the snorkel may be usable, but it is very inconvenient for such a disposal in the water.

(3) So far as the conventional snorkel is concerned, the mouth at the top end thereof is only about 10–15 cm above the water level when the diver is floating, and no water check device is provided to the mouth at the tail end of snorkel, the tail end directly communicates with the diver's mouth, so a trifling carelessness (such as the snorkel is inclined) or a wave on the water surface may cause the water flowing into the snorkel from time to time to be inhaled into the diver's mouth and lead to the danger of swallowing water or choking the bronchia with water.

(4) The inhaling and exhaling passages of conventional snorkel during use are the same one passage, namely, the inhalation and exhalation are continuously alternated on one passage in a single tube, so when inhaling, the fresh air above the water level is inhaled into the diver's lungs through the tube; and when exhaling, the waste carbon dioxide in his or her lungs is exhaled out of his or her body through the same one tube. However, after exhaling, the interior of tube is filled with the exhaled waste carbon dioxide, so when inhaling once again, the diver has to inhale the waste carbon dioxide filled in the snorkel first and then can inhale the fresh air required by him or her from the exterior of said snorkel, and the residual carbon dioxide in the snorkel is about $\frac{1}{4}$ to $\frac{1}{3}$ quantity of air inhaled into the human body each time, namely, when inhaling each time, the diver has to inhale the waste carbon dioxide amounting to $\frac{1}{4}$ to $\frac{1}{3}$ quantity of air approximately. Therefore, while using the snorkel for a long time, the diver will suffer bodily discomfort, gasp and headache because the required fresh air is not enough but the waste carbon dioxide is too much. Such symptoms denote the anoxia and carbon dioxide poisoning which form a considerable damage to the diver's body and consume and waste his or her physical strength very much.

What are mentioned above show the major drawbacks of conventional snorkel which leaves much to be desired and is not a bare-handed diving aid to be used by everyone without getting through the required training and practice or guidance.

SUMMARY OF THE INVENTION

The present invention is characterized by the following design: the snorkel is co-axial and multi-tubular but the chanlels thereof are separate, namely, the inner tube and outer tube form a double tube; the top ends of these channels are provided with one-way diaphragms: one of these diaphragm allows only the external air flowing into the tube, but another one thereof allows only the air in the tube flowing out of the tube; the outer periphere of these diaphragms is covered with an annular body as their housing, and the body is provided with intake and exhaust holes nearby the diaphragms, and these holes are separated from each other. Therefore, this snorkel is provided with different separate one-way channels for inhalation and exhaustion (exhalation), so when the diver inhales each time, he or she can inhale the fresh air through one of these channels instead of inhaling the waste carbon dioxide exhausted from and left in another one thereof in the reverse direction.

The present invention is further characterized by the following design: a plurality of intake valve ports are provided below the said one-way diaphragm for inhalation and on the top edge of inner periphere of said intake hole, a water check diaphragm is provided on the bottom edge of said inner periphere normally, a sleeve type float is provided below the said water check diaphragm and supported by another annular body outside; normally the air can enter into the inhaling channel from the intake hole through the intake valve ports and the one-way diaphragm, but when the float contacts water (namely, prior to the water arriving at the intake hole), the rising dynamic force of said float goes up to actuate the water check diaphragm so as to automatically close the intake valve ports and avoid the water from flowing into the snorkel and prevent the diver from swallowing water or choking his or her bronchia with water.

DETAILED DESCRIPTION OF THE PREFERRED EMBODIMENT

Figure 2:
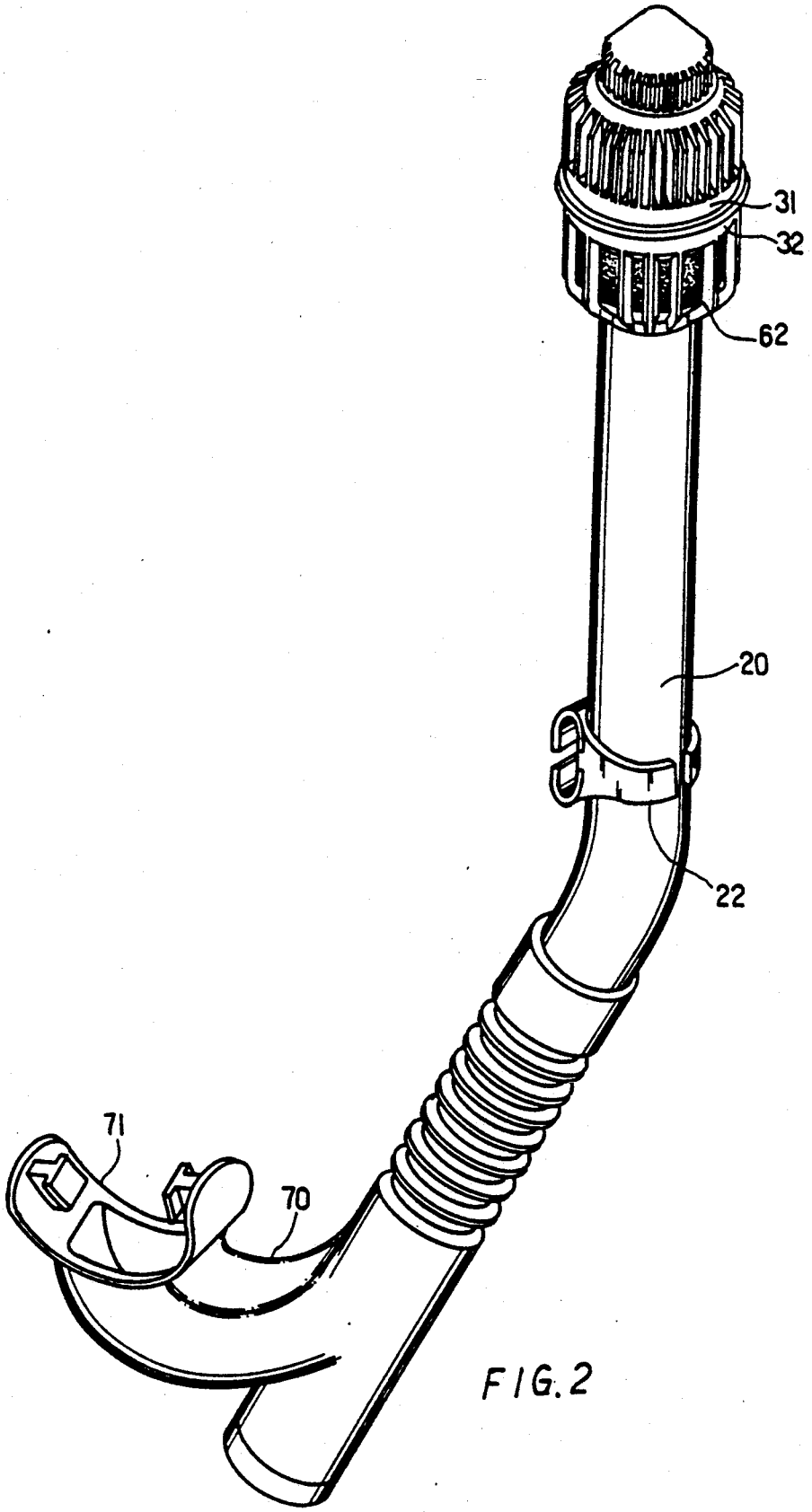
FIG. 2 shows the appearance of assembly of the present invention.
Figure 3:
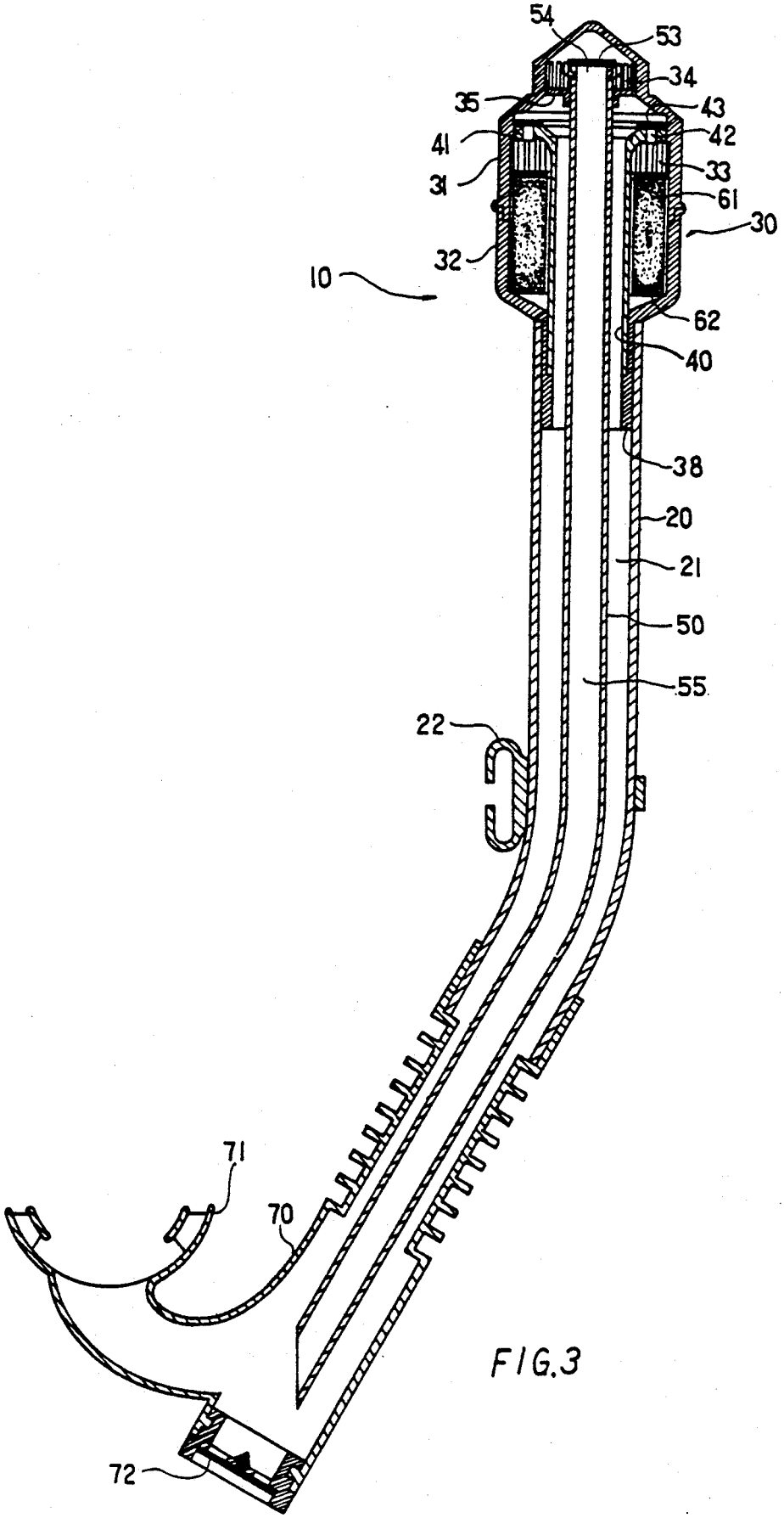
FIG. 3 is a section view of assembly of the present invention.

As shown in FIGS. 2 and 3, the present invention is a vertical co-axial multitubular structure, namely, a novel design including the top structure and co-axial multitubular body of snorkel.

Figure 1:
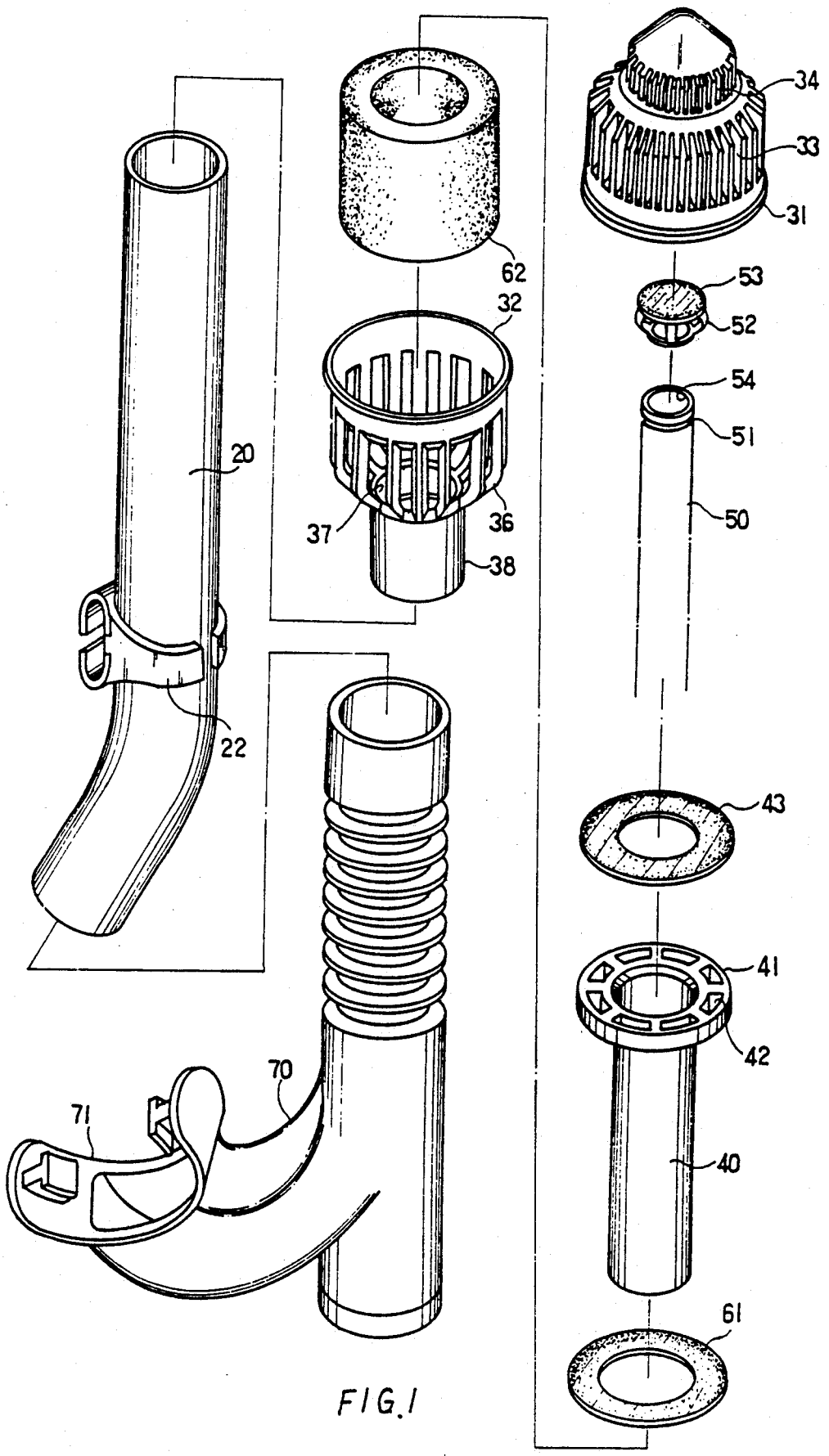
FIG. 1 is a breakdown view of the present invention.
Figure 4:
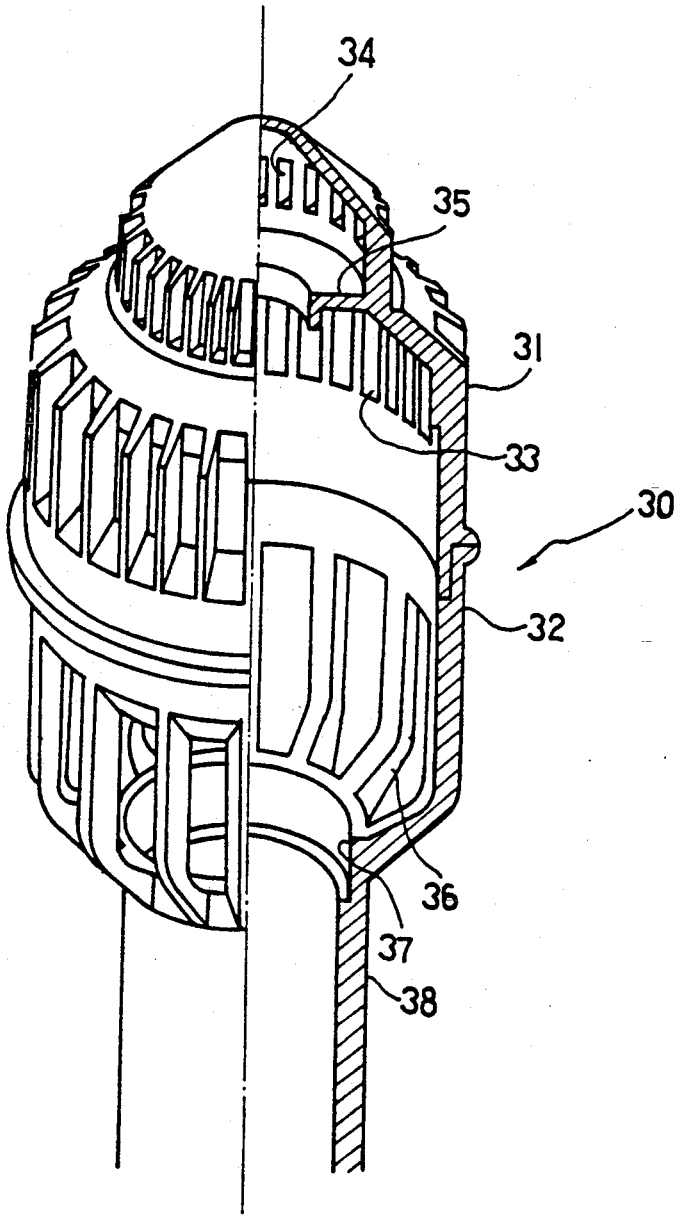
FIG. 4 is an elevational view of annular body the present invention and shows a partial section view thereof.

As shown in FIGS. 1, 2 and 3, the top end of outer tube 20 of snorkel 10 is provided with an annular body 30 consisting of an upper annular body 31 and a lower annular body 32. The detailed structure of said annular body 30 is shown in FIG. 4, wherein a plurality of grid-shaped holes are provided to the upper annular body 31 along the annular path of said body 31 and in the positions thereon with different heights respectively so as to form intake holes 33 and exhaust holes 34 which had better be slots for inhalation and exhaustion and can prevent the foreign things from entering into the snorkel. An annular partition plate 35 is provided traverse between these intake holes 33 and exhaust holes 34, and the top of the following inner tube 50 is fixed through the center hole of said annular partition plate. The lower annular body 32 is provided with a plurality of grids 36 arranged annularly, and an annular recess 37 is provided to the inner wall at the bottom of said body 32 for engagement with the following middle thimble 40. In addition, a hollow pillar 38 is extended from the said bottom for engagement with the outer tube 20, and the upper annular body 31 is designed to engage with the lower annular body 32 after the following members are well assembled.

A middle thimble 40 is inserted into the annular recess 37 of lower annular body 32 and extended upward, and the top end of said thimble 40 is enlarged outward to become an intake valve 41 which is provided with a plurality of intake valve ports 42 arranged annularly. The said intake valve 41 and intake valve ports 42 are disposed at the top edge on the inner periphere of intake hole 33, and the top end of each intake valve port 42 is provided with an annular flat one-way check diaphragm 43 (referred to as the inhaling diaphragm hereinafter) which can open or close one way only so that the foreign air can enter into the snorkel from the intake hole 33 through the intake valve port 42 but the air in the snorkel cannot be exhausted out.

An annular flat water check diaphragm 61 (referred to as the water check diaphragm hereinafter) and a sleeve type float 62 (referred to as the float hereinafter) are provided below the intake valve 41 one after another, around the outer periphere of middle thimble 40 and inside the inner wall of annular body 30, and thus can slide up and down freely in the space between the said outer periphere and inner wall to act as a microswitch to control the opening and closing of said intake valve port 42 so far as the bottom edge of said intake valve port 42 above them is concerned. Normally the float 62 is in its lower position because of its own weight and supported by the grids 36 on the lower annular body 32, and meantime, the water check diaphragm 61 is on the bottom edge on the inner periphere of intake hole 33 and will not hinder the air flow circulating in the said intake hole 33.

An inner tube 50 is disposed deep in the snorkel and at the center of middle thimble 40 and outer tube 20, namely, the inner tube 50 and the outer tube 20 are co-axial but their diameters differ from each other obviously. The top end of inner tube 50 is fixed at the center of annular partition plate 35 on the upper annular body 31, a concave ring 51 is provided to the outer periphere of top end of the inner tube 50 so as to catch a flat one-way check diaphragm 53 (referred to as the exhaust diaphragm hereinafter) with a thin neck belt 52 to cover the tube mouth 54 (exhaust tube mouth). The said exhaust diaphragm 53 also can open or close one way only, i. e. only let the air in the tube exhaust out herefrom through the exhaust holes 34 but can prevent the foreign air from entering into the tube herefrom. The foregoing exhaust holes 34 on the upper annular body 31 are around and nearby the exhaust diaphragm 53.

The hollow passage of inner tube 50 becomes the exhaust channel 55, and the channel between the inner wall of outer 20 (including the middle thimble 40) and the outer wall of inner tube 50 becomes the inhaling channel. These two channels are separate from each other.

The bottom end of outer tube 20 is connected to a bend 70, a rebber holder 71 is provided to one side of said bend 70 to be held in the diver's mouth for breathing; an automatic drain valve 72 which can open outward only is provided to the bottom end of bend 70 so that only a little bit of water accumulated in the tube can be drained out of the snorkel through the automatic drain valve 72 from time to time; in addition, a catch 22 is provided to a suitable position on the outer tube 20 so as to catch the snorkel onto the front end of rubber tape on one side of diving mask (not shown in the drawing) and to keep the snorkel as a whole in a vertical state.

Figure 5:
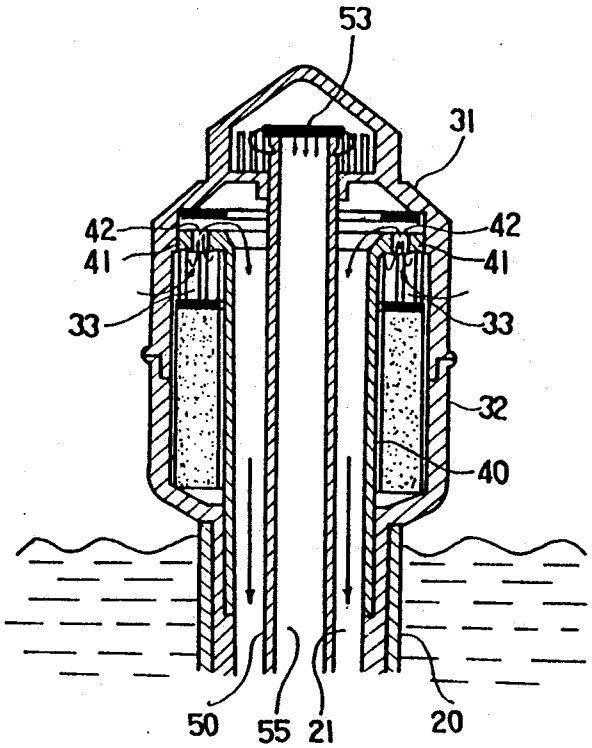
FIG. 5 is an optional view of important action in the state of inhalation when using the present invention.

As shown in FIG. 5, when using the present invention, the snorkel 10 is vertical to the water level, wherein the float 62 is in the lowest position under the action of gravity, and the water check diaphragm 61 above it is below the bottom edge of intake holes 33 under the said action so the bottom of intake valve ports 42 is open; when inhaling, the inhaling pressure generates a negative pressure against the inner tube 50 so as to let the exhaust diaphragm 53 of exhaust tube mouth 54 tightly close the said tube mouth 54, and all the fresh air inhaled enters into the inhaling channel 21 in the outer tube 20 and then into the user's body through the intake hole 33 and intake valve ports 42 where the air rushes ahead to open the inhaling diaphragm 43.

Figure 6:
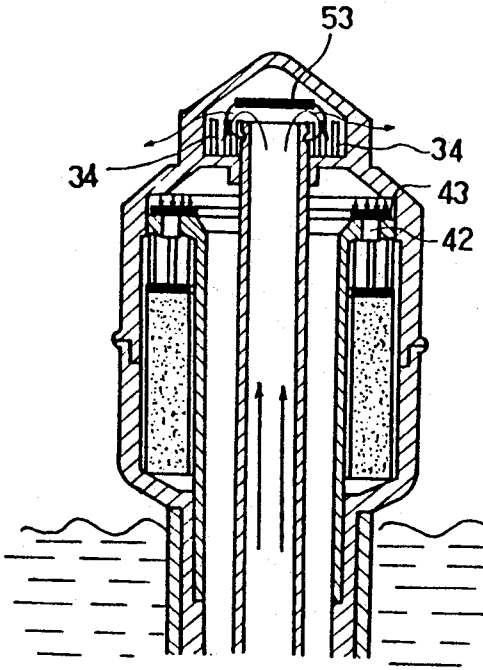
FIG. 6 is an optional view of important action in the state of exhaustion when using the present invention.

As shown in FIG. 6, when exhaling, the snorkel pressure lets the inhaling diaphragm 43 close the top edge of intake valve port 42, the air flow cannot be exhausted out herefrom, so the waste carbon dioxide exhaled out from the diver's body has to rush ahead upward to open the exhaust diaphragm 53 of exhaust tube mouth 54 and then be exhausted out of the snorkel from the exhuat channel 55 of inner tube 50 through the exhaust hole 34.

When the diver inhales and exhales (exhausts) each time, the inhaled fresh air and the exhausted waste carbon dioxide enters into and quits from this snorkel through the separate channels respectively; and such a continuous cyclic operation lets the diver inhale the air which is fresh each time but will not let him or her inhale the waste carbon dioxide exhaled by him or her and left in the exhausts channel 55 of inner tube 50.

Figure 7:
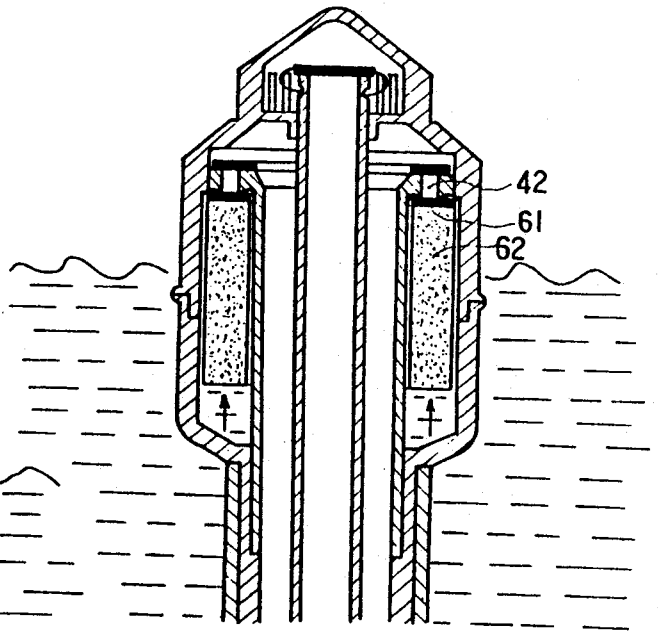
FIG. 7 is an optional view of important action when the float contacts water during the use of the present invention.

As shown in FIG. 7, when the float 62 contacts the water, the intake valve ports 42 can be automatically closed so as to avoid the water flowing into the snorkel. When the diver uses the present invention, whatever happens, for instance, surf,wave, the diver's head in an incorrect angle druing floating or the diver dives down, it is the float 62 in its lowest position first contacts the water level. When contacting the water level, the floating force of water leads to the rising of float 62 at once and the float 62 actuates the water check diaphragm 61 above it to rise at the same time, so that prior to the water arriving at the intake valve ports 42, the water check diaphragm 61 has closed the bottom edge of said intake vavle ports 42, the water is then detered outside the intake valve ports 42 in order to achieve the purpose of checking water automatically and avoid the diver inhaling the water into his mouth or choking his or her bronchia with the water.

I claim:

1. A vertical co-axial multi-tubular diving snorkel which comprises an outer tube having a top end; an inner tube disposed substantially coaxially inside said outer tube and said tubes being coaxial and dimensioned to provide an exhale channel within said inner tube and an inhale channel formed by a clearance between said tubes; a middle thimble provided at the top end of said outer tube, a plurality of intake valve ports provided at an end of said inhale channel proximate to a top end of said middle thimble and which have upper and lower ends, a first flat annular one-way check inhaling diaphragm arranged for movements between positions spaced from and abutting against said upper ends of said intake valve ports to allow fresh air to enter only into said inhale channel through said intake valve ports when said first diaphragm is spaced from said intake valve ports; a second flat one-way check exhaling diaphragm to allow air in the snorkel to be exhausted only out of said exhale channel; an annular body as a housing is provided at the top of the snorkel and having a plurality of spaced intake holes and exhaust holes proximate to associated inhaling and exhaust diaphragms, said intake holes having a top edge on an inner periphery thereof; an annular flat water check diaphragm; and a sleeve type float fully contained within said annular body normally below said lower ends of said intake valve ports on the top edge on the inner periphery of said intake holes, said water check diaphragm normally being on the bottom edge on said inner periphery of said intake holes and being urged into abutment against said lower ends of said intake valve ports to prevent air or water from entering said inhale channel when said float is buoyed up by water.

2. A vertical co-axial mutli-tubular diving snorkel as claimed in claim 1, wherein said annular body consists of a lower annular body and an upper annular body.

3. A vertical co-axial multi-tubular diving snorkel as claimed in claim 2, wherein the lower annular body is provided with a plurality of annularly arranged grids to suport the float, and a hollow pillar is extended from the bottom of said body to engage with the top end of outer tube.

4. A vertical co-axial multi-tubular diving snorkel as claimed in claim 2, wherein a plurality of grid-shaped holes are provided to the upper annular body along the annular path of said body and in the positions thereon with different heights respectively so as to form intake holes and exhaust holes, and an annular partition plate is provided traverse between these intake holes and exhaust holes.

5. A vertical co-axial multi-tubular diving snorkel as claimed in claim 1 or 4, wherein the intake holes and exhaust holes are slots.

6. A vertical co-axial multi-tubular diving snorkel as claimed in claim 1 or 3, wherein a middle thimble is inserted into the annular recess of lower annular body and extended upward, and the top end of said thimble is enlarged outward to become an intake valve which is provided with a plutality of intake valve ports arranged annularly.

7. A vertical co-axial multi-tubular diving snorkel as claimed in claim 1, wherein the water check diaphragm and the float are provided around the outer periphery of middle thimble and inside the inner wall of annular body, and thus can slide up and down freely in the space between the said outer periphery and inner wall to act as a microswitch to control the opening and closing of said intake valve ports so far as the bottom edge of said intake valve ports above them is concerned.

8. A vertical co-axial multi-tubular diving snorkel as claimed in claim 1 or 4, wherein the top of inner tube is fixed at the center of annular partition plate of annular body.

9. A vertical co-axial multi-tubular diving snorkel as claimed in claim 1, wherein a concave ring is provided to the outer periphere of top end of the inner tube so as to catch an exhaust diaphragm with a thin neck to cover the tube mouth of inner tube.

* * * * *